US006022253A

United States Patent [19]

Ozawa et al.

[11] Patent Number: 6,022,253

[45] Date of Patent: Feb. 8, 2000

[54] INJECTION SYSTEM FOR SMALL WATERCRAFT

[75] Inventors: Shigeyuki Ozawa; Ryoichi Nakase, both of Iwata, Japan

[73] Assignee: Yamaha Hatsudoki Kabushiki Kaisha, Iwata, Japan

[21] Appl. No.: 09/008,240

[22] Filed: Jan. 16, 1998

[30] Foreign Application Priority Data

Jan. 16, 1997 [JP] Japan ..... 9-020029

[51] Int. Cl.[7] ..... B63H 21/32

[52] U.S. Cl. ..... 440/89; 440/88

[58] Field of Search ..... 440/1, 2, 76, 77, 440/88, 89; 114/270

[56] References Cited

U.S. PATENT DOCUMENTS

| | | | |
|---|---|---|---|
| 5,553,579 | 9/1996 | Yoshida et al. | 123/295 |
| 5,558,549 | 9/1996 | Nakase et al. | 440/88 |
| 5,846,102 | 12/1998 | Nitta et al. | 440/88 |

*Primary Examiner*—Stephen Avila
*Attorney, Agent, or Firm*—Knobbe, Martens, Olson & Bear LLP

[57] ABSTRACT

An arrangement for at least one fuel injector associated with a fuel injection system of an engine powering a water propulsion device of a watercraft is disclosed. The watercraft has a hull defining an engine compartment and includes a water propulsion device. An internal combustion engine has a cylinder head connected to a top end of a cylinder block and cooperating with the cylinder block to define at least one combustion chamber. The engine is positioned in the engine compartment and has an output shaft arranged to power the water propulsion device. At least one air duct provides air through the hull into the engine compartment, the duct leading from the hull to an outlet in the engine compartment. The engine has an intake system for providing air to the combustion chamber and a fuel system for providing fuel to the combustion chamber, the fuel system including at least one fuel injector extending from the cylinder head positioned above the air duct outlet and shielded by the engine from water.

14 Claims, 8 Drawing Sheets

INJECTION SYSTEM FOR SMALL WATERCRAFT

FIELD OF THE INVENTION

The present invention relates to a fuel injector arrangement. More particularly, the invention is a fuel injector arrangement for an engine of the type powering a small watercraft.

BACKGROUND OF THE INVENTION

Internal combustion engines are commonly used to power small watercraft such as personal watercraft. These watercraft include a hull which defines an engine compartment. The engine is positioned in the engine compartment. The output shaft of the engine is coupled to a water propulsion device of the watercraft, such as an impeller.

Air must be supplied to the engine from outside the hull for use in the combustion process. Typically, air flows through one or more ducts in the hull into the engine compartment, and then through an intake system of the engine to the combustion chamber(s) thereof.

Fuel is also supplied to the engine for use in the combustion process. In order to accurately meter the fuel and improve engine operating efficiency and performance, the fuel is injected with one or more fuel injectors. In this arrangement, fuel is supplied to the fuel injectors at high pressure. Each injector has an electrically operated valve which selectively opens and closes, controlling the flow of fuel therethrough to the engine.

One problem associated with this arrangement is that water may contact the injector and damage it. In particular, water often flows with the air through the intake ducts into the engine compartment. This water may directly flow onto the injector, or pools in the bottom of the hull and splashes about due to the pitching and rocking movement of the watercraft as it moves through the water. When the water sprays or splashes onto the fuel injector, it may corrode the injector and interrupt the electrical current flowing thereto and controlling the injector. This may result in damage to the injector and may affect the operation of the engine.

In order to keep the size of the watercraft small and the center of gravity low, the engine compartment is made very small, thus necessitating that the engine be compact. One problem with this arrangement is that hot exhaust gasses flowing through the exhaust system from the engine may be routed very closed to other components of the engine, damaging them or resulting in their poor performance. This is true of the fuel injectors, where the heat from the exhaust system may damage the injector and shorten its useful life.

An improved fuel injector arrangement for an engine of the type utilized to power a small watercraft, such as a personal watercraft, is desired.

SUMMARY OF THE INVENTION

In accordance with the present invention there is provided an improved fuel injector arrangement for a fuel injection system of an engine powering a small watercraft.

Preferably, the watercraft is of the type having a hull defining an engine compartment. The watercraft includes a water propulsion device. At least one air duct provides air through the hull into the engine compartment, the duct leading from the hull to an outlet in the engine compartment.

The internal combustion engine has a cylinder head connected to a top of a cylinder block and cooperating therewith to define at least one combustion chamber. The engine is positioned in the engine compartment of the watercraft, and has an output shaft arranged to power the water propulsion device of the watercraft.

The engine has an intake system for providing air to the combustion chamber(s) thereof and a fuel system for providing fuel to the combustion chamber(s) for combustion with the air. The fuel system includes at least one fuel injector which delivers fuel to the combustion chamber(s).

In the arrangement of the present invention, each fuel injector is connected to the engine and positioned higher above a bottom of the hull than the outlet of the air duct. In a preferred embodiment, each injector extends from the cylinder head so as to be protected from splashing water by the body of the engine. In addition, each injector preferably extends from the cylinder head in an area away from a portion of an exhaust system associated with the engine to protect the injector from heat.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

The present invention is a fuel injector arrangement for one or more fuel injectors associated with a fuel injection system which supplies fuel to an engine of the type utilized to power a small watercraft. The fuel injector arrangement is described in conjunction with an engine powering a personal watercraft since this is an application for which the arrangement has particular utility. Those of skill in the art will appreciate that the arrangement may have utility in a wide variety of other settings.

Figure 1:
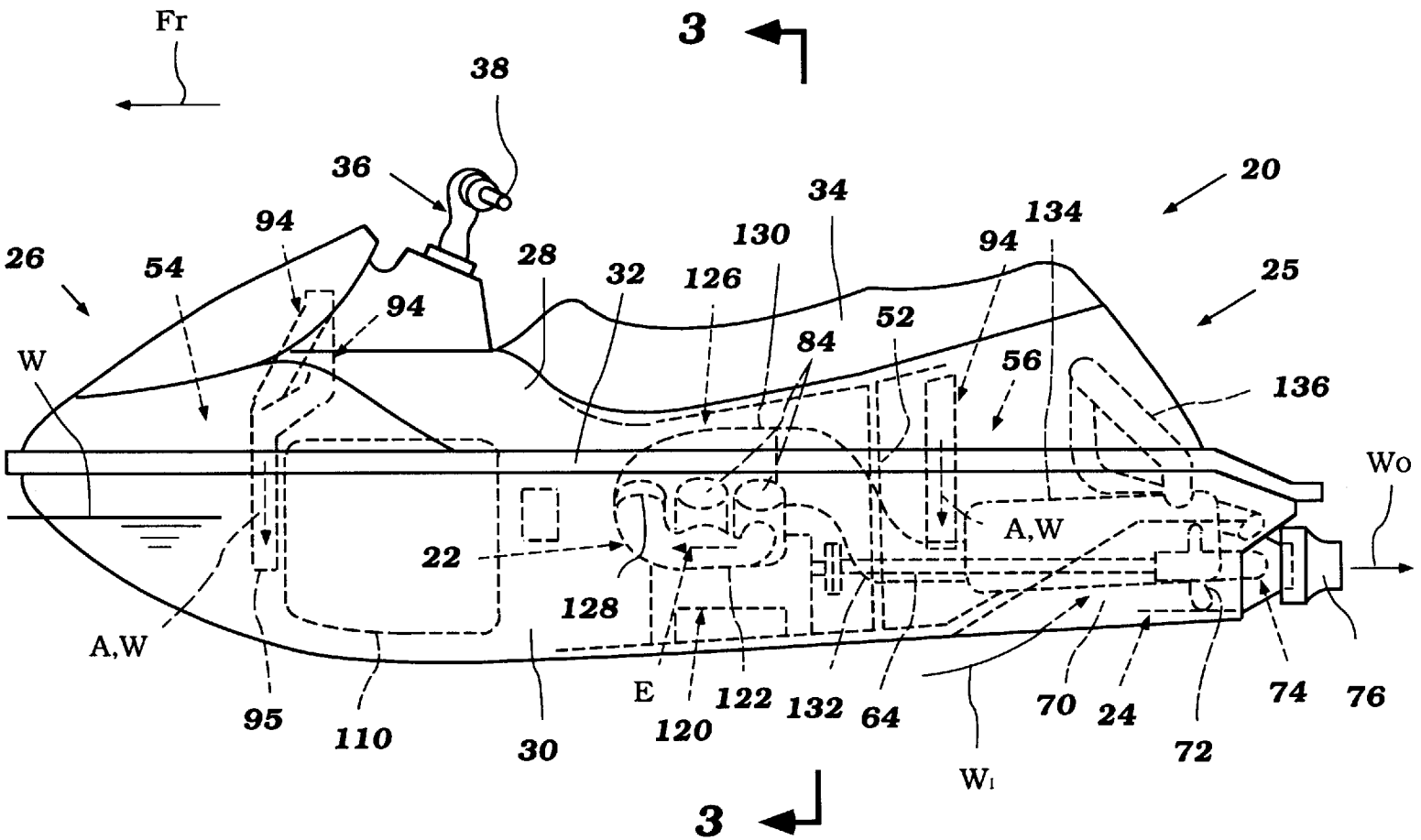
FIG. 1 is a side view of a personal watercraft of the type powered by an engine having a fuel injector arrangement in accordance with a first embodiment of the present invention, the engine and other watercraft components positioned within a hull of the watercraft illustrated in phantom.
Figure 2:
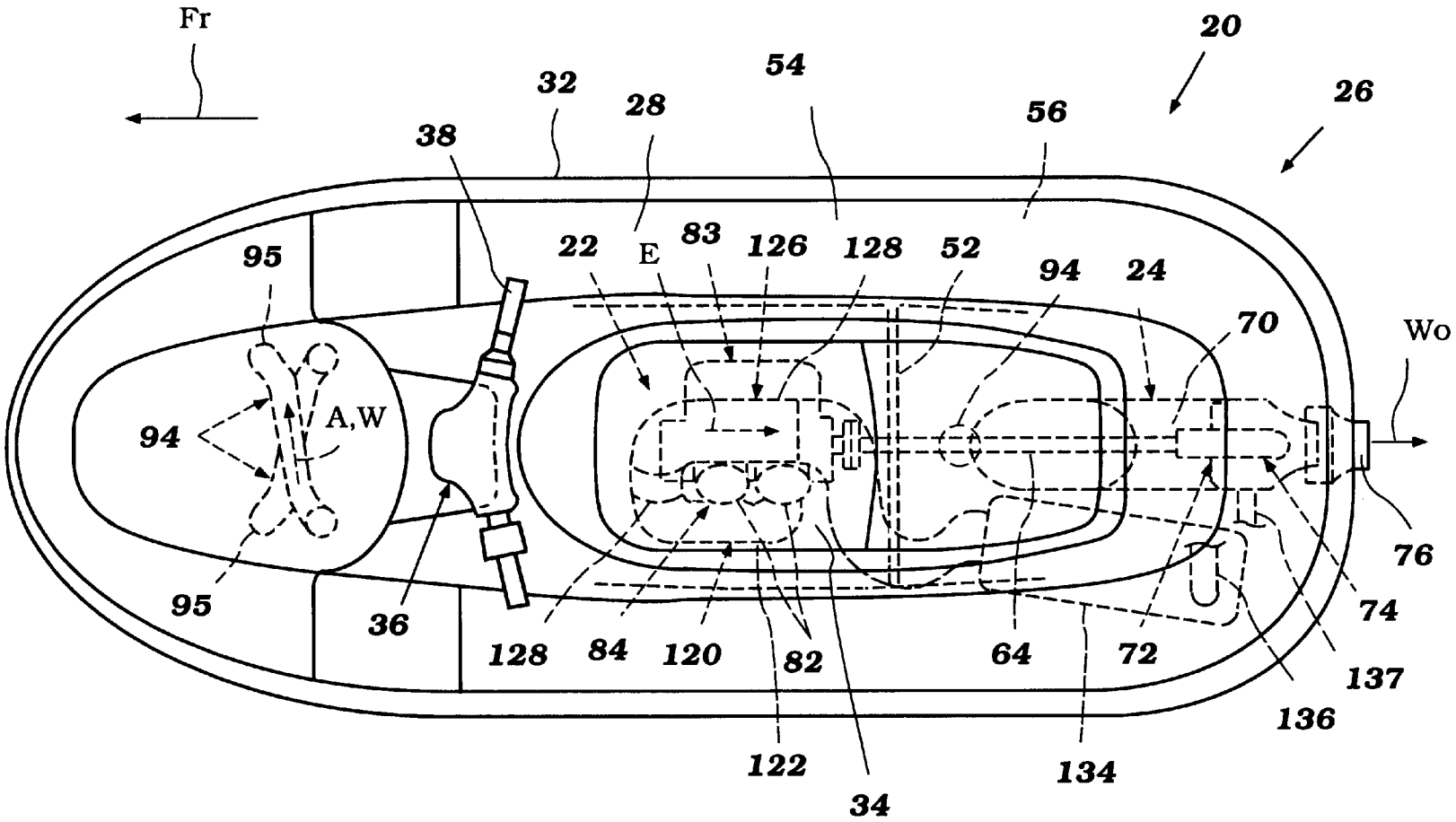
FIG. 2 is a top view of the watercraft illustrated in FIG. 1, with the engine and other watercraft components positioned within the watercraft illustrated in phantom.

FIGS. 1 and 2 illustrate a watercraft 20 having a watercraft body 25 comprising a hull 26 having a top portion or deck 28 and a lower portion 30. A gunnel 32 defines the intersection of the lower portion 30 of the hull 26 and the deck 28. The watercraft 20 is suited for movement through a body of water W in a direction Fr (towards a front end of the watercraft).

A seat 34 is positioned on the top portion 28 of the hull 26. The seat 34 is preferably connected to a first removable deck member. A steering handle 36 is provided adjacent the seat 34 for use by a user in directing the watercraft 20. Preferably, a throttle control grip 38 is provided on the steering handle 36 for use in controlling the speed of the watercraft 20 as described in more detail below.

Figure 3:
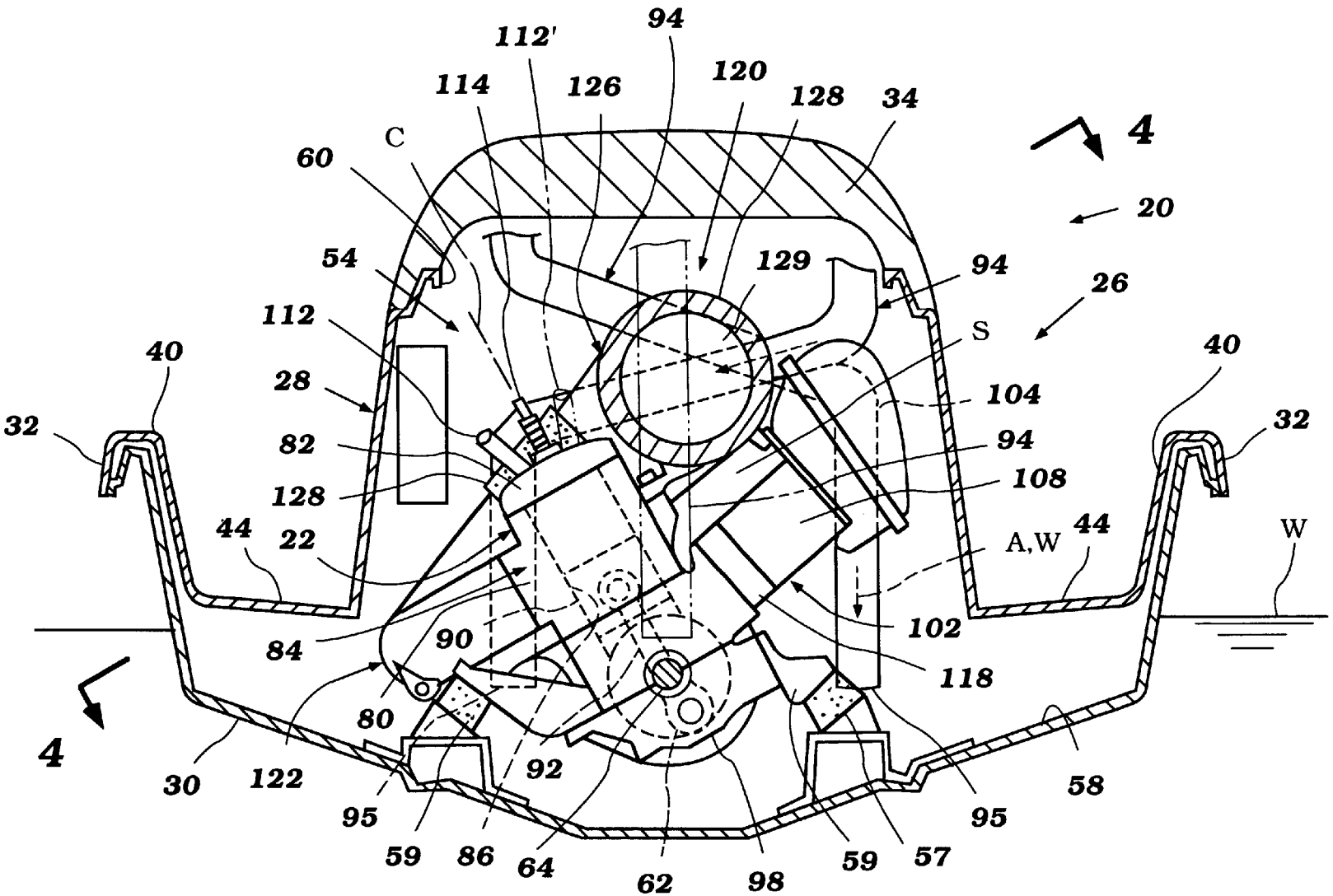
FIG. 3 is a cross-sectional end view of the watercraft illustrated in FIG. 1, taken along line 3—3 therein.

As best illustrated in FIG. 3, a bulwark 40 extends upwardly along each side of the watercraft 20. A foot step area 44 is defined between the seat 34 and the adjacent bulwarks 40.

The top and bottom portions 28,30 of the hull 26, along with a bulkhead 52, define an engine compartment 54 and a pumping or propulsion unit compartment 56. The engine 22 is positioned in the engine compartment 54. As best illustrated in FIG. 3, the engine 22 is connected to the hull 26 with several brackets 59 via engine mounts 57 connected to a bottom 58 of the lower portion 30 of the hull 26. The engine 22 is preferably partially accessible through a maintenance opening 60 accessible by removing a deck member on which the seat 34 is mounted.

The engine 22 has a crankshaft 62 (see FIG. 3) which is in driving relation with an impeller shaft 64. The impeller shaft 64 rotationally drives a means for propelling water of a propulsion unit 24, which unit extends out a stern portion of the watercraft 20 (see FIG. 1).

The propulsion unit 24 includes a propulsion passage 70 having an intake port which extends through the lower portion 30 of the hull 28. The means for propelling water, preferably an impeller 72 driven by the impeller shaft 64, is positioned in the passage 70. The passage 70 also has an outlet jet 74 which discharges into a nozzle 78. The nozzle 78 is mounted for movement for directing water Wo which is expelled from the rear or stern of the watercraft 20, whereby the direction of the propulsion force for the watercraft 20, and thus its direction, may be varied. Preferably, the position of the nozzle 78 is controlled with the steering handle 36.

Figure 4:
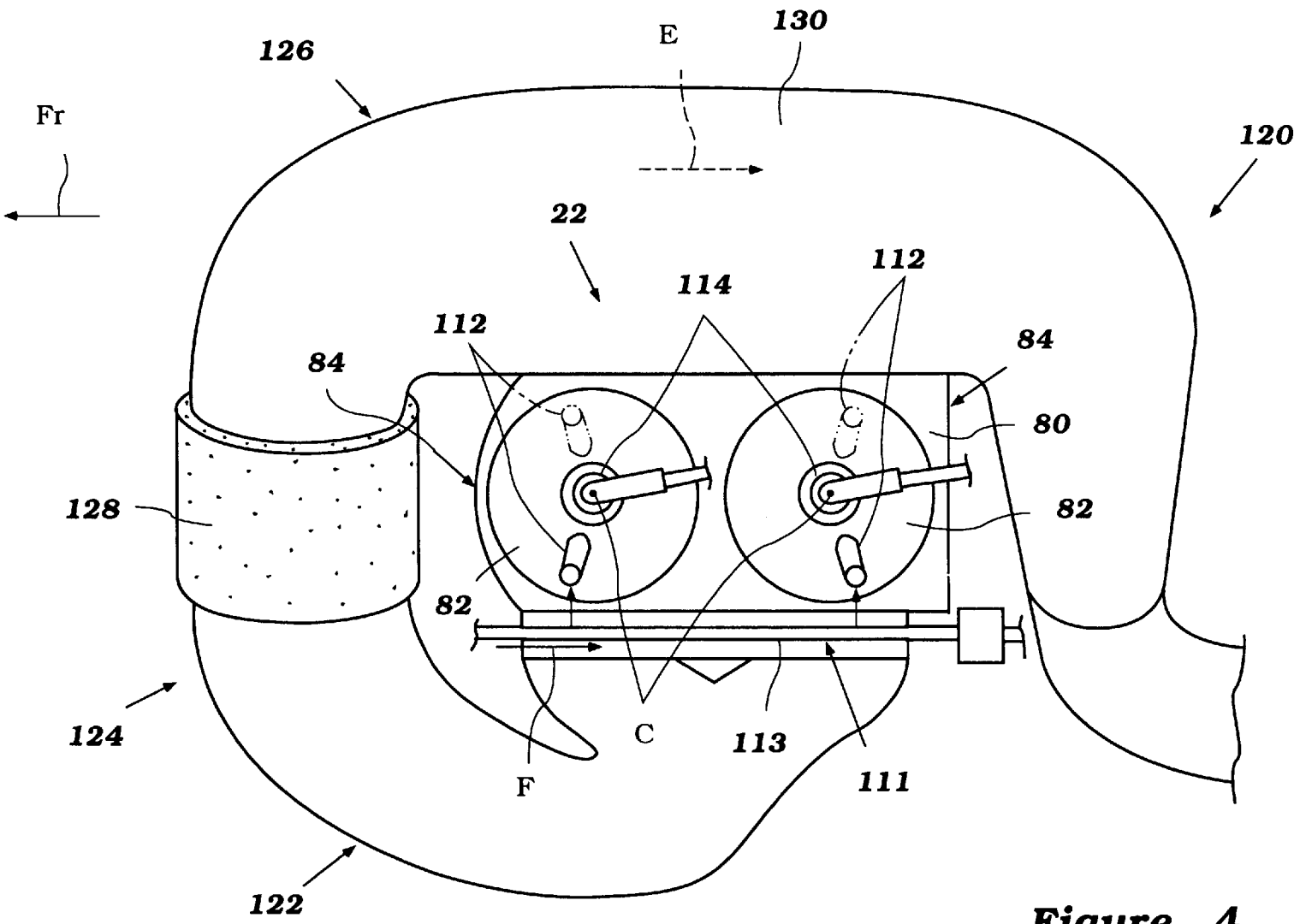
FIG. 4 is a top view of the engine illustrated in FIG. 3, taken in the direction of line 4—4 therein.
Figure 5:
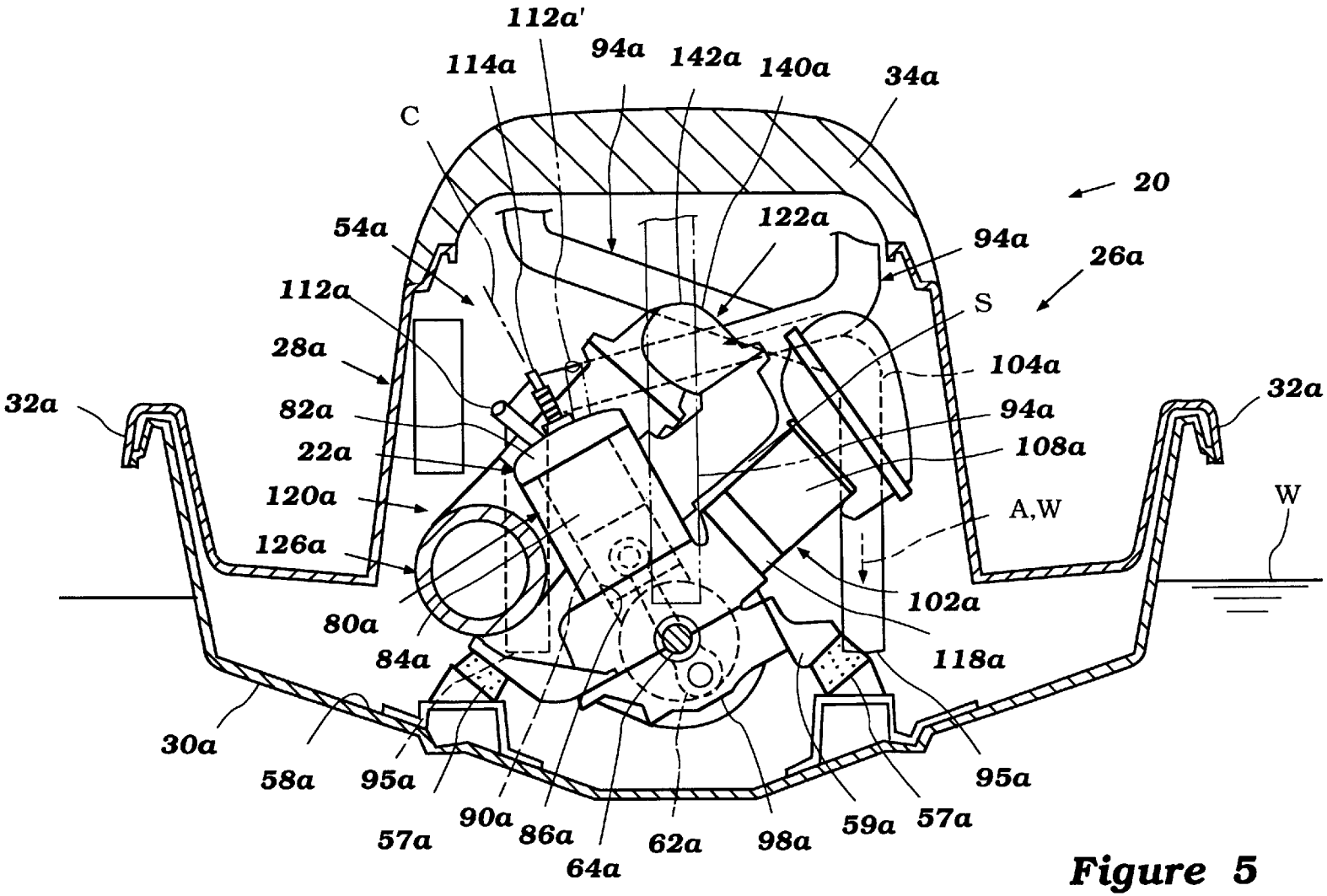
FIG. 5 is a cross-sectional end view of a watercraft powered by an engine having a fuel injector arrangement in accordance with a second embodiment of the present invention.

The engine 22 is best illustrated in FIGS. 3–5. As illustrated therein, the engine 22 is preferably of the two-cylinder, two-cycle variety. Of course, the engine 22 may have as few as one, or more than two, cylinders, as may be appreciated by one skilled in the art.

The engine 22 includes a cylinder block 80 having a cylinder head 82 connected thereto and cooperating therewith to define two combustion chambers, preferably in the form of cylinders 84. A piston 90 is movably mounted in each cylinder 84 and slides along a cylinder wall 86 defined by the cylinder block 80. The piston 90 is connected to the crankshaft 62 via a connecting rod 92, as is well known in the art. Preferably, the engine 22 is tilted so that the cylinders 84 have a centerline C which is offset in a first direction from a vertical axis. As is well known in the art, this arrangement keeps the vertical profile of the engine small, allowing the watercraft 20 to be designed with a low center of gravity.

As best illustrated in FIG. 3, the engine 22 includes means for providing an air to each cylinder 84. Preferably, air is drawn into the engine compartment 54 through several air ducts 94. As illustrated, a pair of ducts 94 are positioned in front of the engine 22 near the front end of the watercraft 20, and another duct 94 is positioned behind the engine 22 towards the stem of the watercraft. Each duct 94 defines a passage leading through the hull 26 to an outlet 95 positioned in the engine compartment 54. So arranged, air A flows from outside of the hull 26 into the engine compartment 54. In addition, however, water W may flow through these ducts 94 into the engine compartment 54 with the air A.

Air within the engine compartment 54 is supplied to the engine 22 through an air intake system 102. The intake 102 includes an intake box or silencer 104 into which air from within the engine compartment 54 is drawn, the air then delivered therefrom to a passage through a throttle body 108. A throttle valve (not shown) is movably positioned in the passage through the throttle body 108. The valve is preferably controlled by the throttle control 38 located at the steering handle 36, and is arranged control the flow rate of air through the throttle body 108.

The air which selectively passes beyond the throttle valve then selectively passes through an intake port into a crankcase 98 as controlled by a reed valve 118, as is known in the art. The crankcase 98 is preferably defined at the bottom of the engine 22 by the cylinder block 80 and a crankcase cover member. As illustrated in FIG. 3, the crankshaft 62 is rotatably positioned in the crankcase 98.

The crankcase 98 is compartmentalized into crankcase chambers, one chamber each corresponding to each cylinder 84. As is well known, an intake port and corresponding reed valve 118 are preferably provided corresponding to each cylinder 84.

In this arrangement, air delivered to a particular crankcase chamber is partially compressed by the downward movement of the piston 90 corresponding to that chamber. This air is then delivered from the crankcase 98 to the cylinder 84 through one or more scavenge passages (not shown). When the piston 90 moves upwardly, air is drawn through the reed valve 118 into the crankcase 98 to supply the next air charge.

Fuel is provided to each cylinder 84 by a fuel system 111. In the embodiment illustrated, fuel is drawn from a fuel tank 110 (see FIG. 1) positioned in the engine compartment 54 by a fuel pump (not shown). The fuel is delivered at high pressure through a fuel rail or tube 113 to a fuel injector 112 corresponding to each cylinder 84 and which delivers fuel thereto. The fuel injectors 112 will be described in more detail below.

A suitable ignition system is provided for igniting the air and fuel mixture in each combustion chamber. Preferably, this system comprises a spark plug 114 (see FIG. 3) corresponding to each cylinder 84. The spark plugs 114 are preferably fired by a suitable ignition system as well known to those of skill in the art.

Exhaust gas generated by the engine 22 is routed from the engine to a point external to the watercraft 20 by an exhaust system 120 which includes an exhaust passage leading from each cylinder 84 through the cylinder block 80. An exhaust manifold or pipe 122 is connected to a side of the engine 22. As best illustrated in FIG. 3, the exhaust manifold 122 is connected to the side of the engine 22 towards which the engine tilts, while the intake system 102 of the engine 22 extends from the opposite side of the engine.

The manifold 122 has a pair of branches each having a passage therethrough which aligns with one of the exhaust passages leading through the cylinder block 80 from a cylinder 84. The branches of the manifold 122 merge at a merge pipe portion 124 of the manifold which curves around the front end of the engine 22. The merge pipe portion 124 has a passage through which the exhaust is routed.

An expansion pipe 126 is connected to the exhaust manifold 122, preferably via a flexible member 128, such as a rubber sleeve. The expansion pipe 126 has an enlarged passage or chamber 129 (see FIG. 3) through which exhaust E flows from the passage in the exhaust manifold 122. As illustrated, the expansion pipe 126 extends from its connection to the manifold 122 near the front end of the engine 22 around the opposite side of the engine (i.e. to the side at which the intake system extends). A middle section 130 of the expansion pipe 126 extends along the side of the engine 22 towards its rear end. As best illustrated in FIG. 3, the expansion pipe 126 is spaced (S) from the intake 102. A catalyst (not shown) may be positioned within the expansion pipe 126.

After flowing through the expansion pipe 126, the exhaust flows into an upper exhaust pipe section 132 of the exhaust system 120 (see FIG. 1). This portion of the exhaust system 120 leads to a water lock 134. The upper exhaust pipe 132 is preferably connected to the water lock 134 via a flexible fitting, such as a rubber sleeve. The exhaust flows through the water lock 134, which is preferably arranged as known to those skilled in the art, to prevent the backflow of water through the exhaust system 120 to the engine 22. The exhaust then passes to a lower exhaust pipe 136 which has its terminus in the water near the stem of the watercraft 20. In this manner, exhaust flows from the engine 22 through the exhaust system 120 to its discharge within the water.

The engine 22 may include a suitable lubricating system for providing lubricating oil to the various moving parts thereof and for injection with the fuel. In addition, the engine 22 may include a suitable liquid and/or air cooling system.

The watercraft 20 may include a bilge system for drawing water from within the hull 26 and discharging it into the body of water W. Referring to FIG. 1, this system preferably includes a pipe or hose 137 that has a first end positioned along the bottom of the hull 26 within the engine compartment 54 and a second end positioned in the pumping passage 70. The flow of water through the passage 70 draws fluid through the hose 137 from the engine compartment 54.

Of course, the bilge system may include an electric powered pump or similar pumping mechanism and be arranged to discharge the water at other locations exterior to the interior of the hull 26.

In accordance with the first embodiment of the present invention, the fuel injectors 112 are specifically positioned or arranged so that their exposure to water and heat is reduced or limited. In a first arrangement of this embodiment, an injector 112 is provided corresponding to each cylinder 84. Each injector 112 is connected to a respective portion of the cylinder head 82 and arranged to direct fuel into a respective cylinder 84. Each injector 112 extends upwardly from the cylinder head 82 from that portion of the cylinder head 82 which is opposite the expansion pipe portion 126 of the exhaust system 120.

In this position, each injector 112 is protected from water splashing about the bottom of the hull 26 by the engine 22 and the manifold 122. In addition, the ducts 94 are all arranged so that their outlets 95 are positioned below the injectors 112 (i.e., the outlets 95 are closer to the bottom 58 of the hull 26 than the injector 112), so that water W which enters the ducts with the air A does not flow or spray directly onto the injectors 112.

In addition, in this position the injectors 112 are protected from the heat radiated from the expansion pipe 128 because they are spaced some distance therefrom. The portion of the exhaust system 120 which extends closest to the injectors 112, the laterally extending portion 130 of the expansion pipe 128 which extends along the side of the engine 22 and constitutes the highest portion of the exhaust system 120, is still spaced some distance laterally from the injectors 112.

As illustrated, the injectors 112 preferably extend at an angle from the cylinder head 82, tilting or angling away from the exhaust system 120. In this manner, the injectors 112 are still further protected from the heat radiated by the exhaust system 120.

An alternate position for the injectors 112' is also illustrated in FIGS. 3 and 4. In this position the injectors 112' are still highly protected from water which splashes about the bottom of the hull 26 and from water which enters the engine compartment 54 through the ducts 94. In this position, however, the injectors 112' are slightly closer to the exhaust expansion pipe 128, thus subjecting them to slightly higher heat. The heat transmission is lower than in many other arrangements, however, since an cooling air flow path is defined through space S between the expansion pipe 128 and intake system 102 for cooling the expansion pipe 128.

A fuel injector arrangement in accordance with a second embodiment of the present invention is illustrated in FIG. 5. In the description and illustration of this embodiment of the invention, like or similar parts have been given the same reference numerals as those used in the description and illustration of the previous embodiment, except that an "a" designator has been added to all the reference numerals used herein.

In this embodiment, the exhaust manifold **122*a* extends from the same side of the engine 22*a* as the intake system 102*a*. In this arrangement, the manifold 122*a* extends outwardly from the engine 22*a* to a connecting pipe 140*a*. This connecting pipe 140*a* extends along the side of the engine 22*a* towards its front end. The connecting pipe 140*a* has a longitudinal section 142*a* which constitutes the highest portion of the exhaust system 120*a***.

The connecting pipe **140*a* extends to the expansion pipe 128*a*. The expansion pipe 128*a* extends from the connecting pipe 140*a* around the front end of the engine 22*a* and then along the opposite side of the engine 22*a* from the intake 102*a* and manifold 122*a* to the upper exhaust pipe (not shown). The portion of the expansion pipe 128*a* which extends along the side of the engine 22*a* extends along the engine block 80*a* in that space between the tilted block 80*a* and the engine mounts 56*a* on that side of the engine 22*a***.

In accordance with this embodiment, the injector **112*a* corresponding to each cylinder 84*a* extends from the cylinder head 82*a* upwardly and outwardly therefrom. In a first position, the injector 112*a* is located to that side of the cylinder head 82*a* to which the engine tilts (i.e. towards the side of the engine 22*a* along which the expansion pipe 128*a* extends). In addition, the injector 112*a* is arranged to tilt in the direction the engine tilts, instead of being aligned vertically or parallel to the centerline C, which, as stated above, further protects the injector 112*a* from the heat associated with the exhaust system 120*a***.

In this position, the injector **112*a* is protected from water which splashes about the bottom of the hull 26*a* by the engine 22*a* and expansion pipe 128*a*. In addition, the injector 112*a* is located remotely from the exhaust system heat sources. First, the injector 112*a* is located above the expansion pipe 128*a*, with the engine 22*a* partly shielding the injector 112*a* from the expansion pipe 128*a*. The injector 112*a* is positioned on the opposite side of the cylinder head 82*a* from the connecting part 140*a* of the exhaust system 120*a***.

An alternate injector position **112*a*' is also illustrated in FIG. 5. In this position, the injector 112*a*' extends from that portion of the cylinder head 82***a* which is closer to the connecting part 140*a* of the exhaust system 120*a* In this position the injector 112*a*' is still protected from water. In addition, the injector 112*a*' is still spaced some distance from the exhaust system 120*a*.

Figure 6:
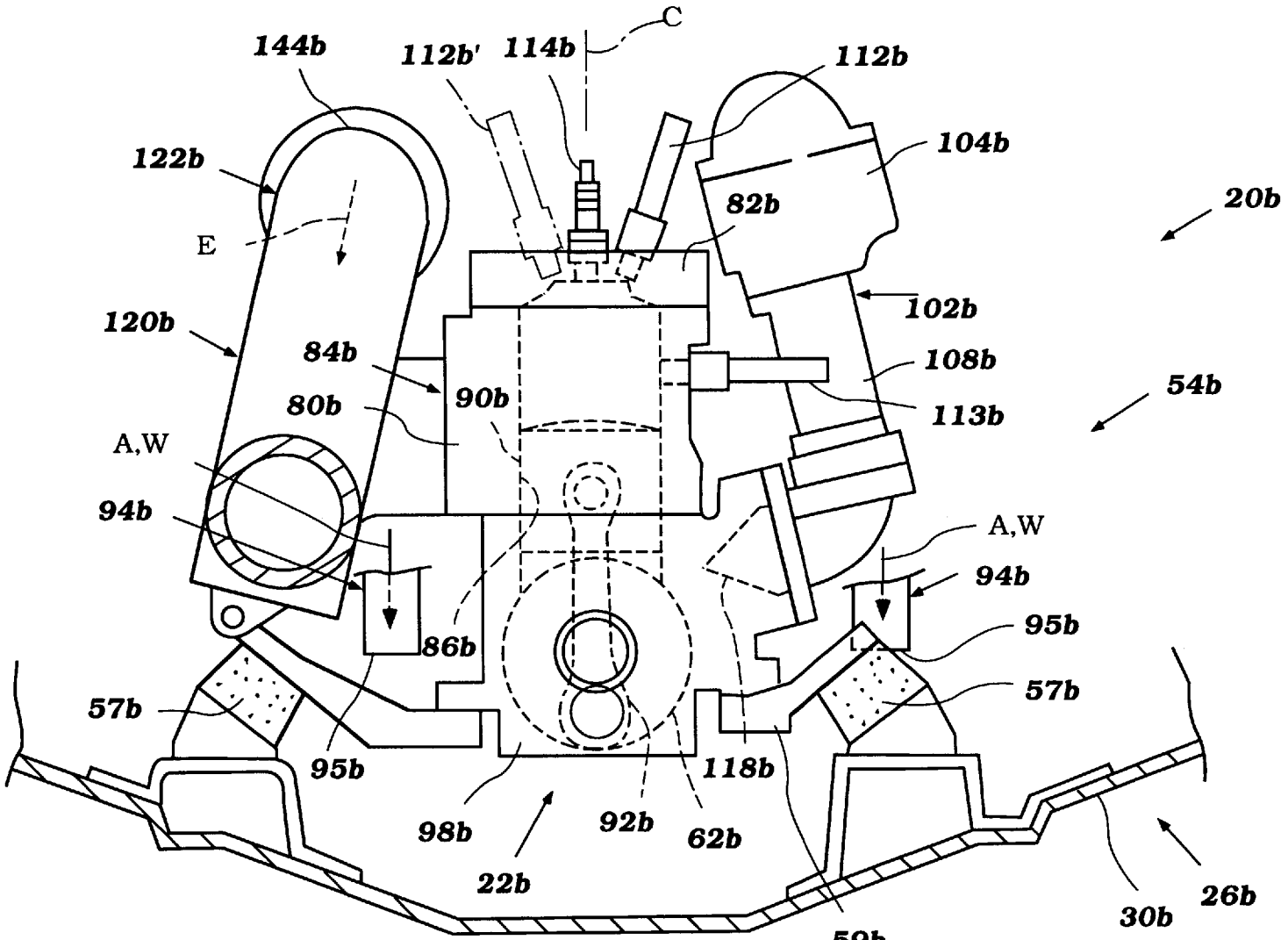
FIG. 6 is partially illustrates, in cross-section, a watercraft powered by an engine having a fuel injector arrangement in accordance with a third embodiment of the present invention.
Figure 7:
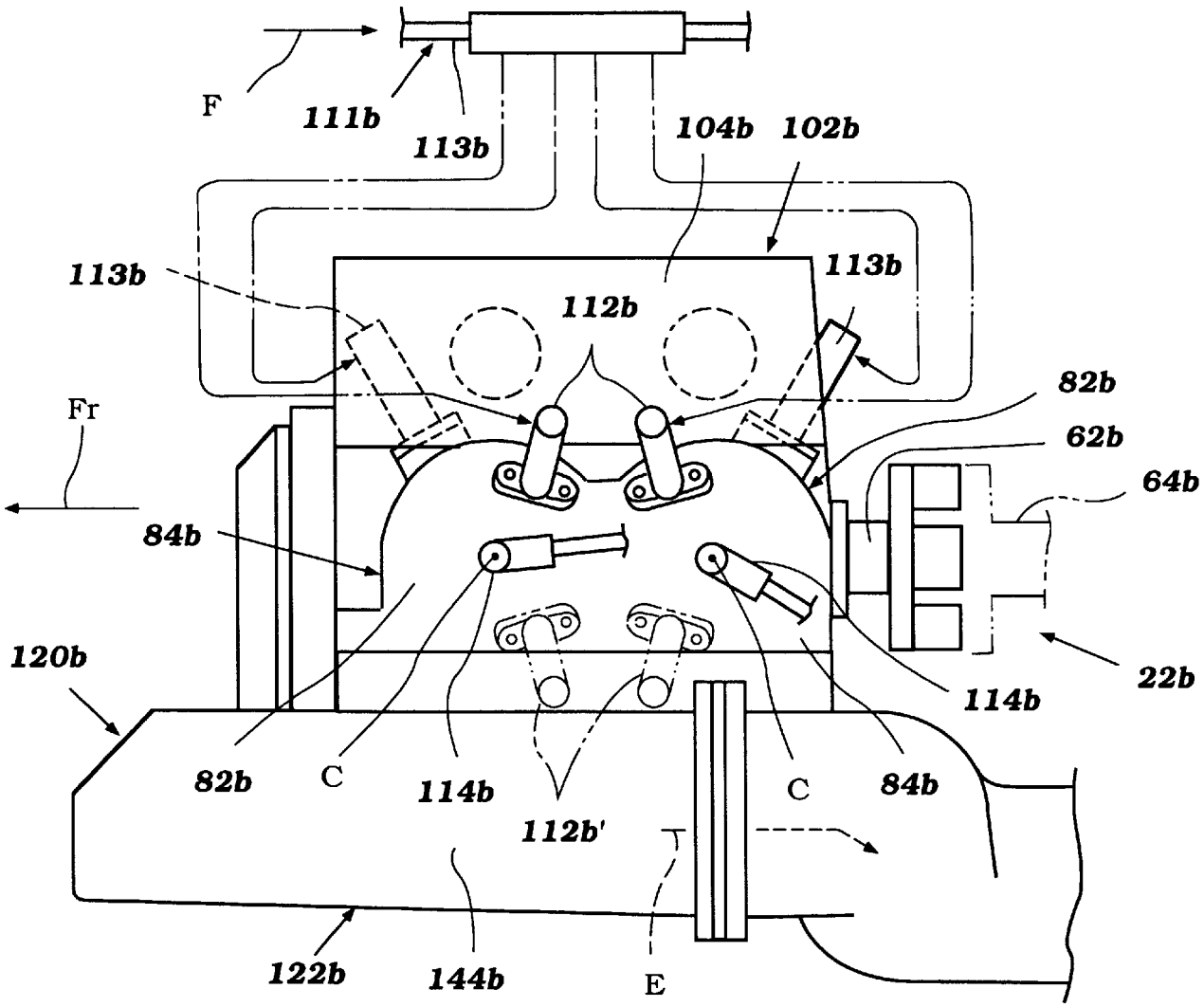
FIG. 7 is top view of the engine illustrated in FIG. 6.

A fuel injector arrangement in accordance with a third embodiment of the present invention is illustrated in FIGS. 6 and 7. In the description and illustrations of this embodiment of the invention, like or similar parts have been given the same reference numerals as those used in the description and illustration of the previous embodiments, except that a "b" designator has been added to all of the reference numerals used herein.

In this embodiment, the engine 22*b* is arranged so that the cylinders 84*a* have a center axis C which is vertically extending (i.e. the engine is not tilted). The intake system 102*b* extends outwardly from one side of the engine, while the exhaust system 120*b* is located at the opposite side of the engine 22*b*. An exhaust manifold 122*b* is connected to the cylinder block 80*b* and extends therefrom. The manifold 122*b* has a longitudinal section 144*b* which extends along the side of the engine 22*b* to the remainder of the exhaust system 120*b* leading to the water lock (not shown) at the rear of the watercraft.

In this embodiment, each fuel injector 112*b* preferably extends upwardly from the cylinder head 82*b*. In the preferred position, the cylinder head 82*b* which i to that side of the cylinder head 82*b* which is closest the intake system 102*b*, and thus farthest from the exhaust system 120*b*, and is tilted away from the exhaust system. In this position, the injector 112*b* is protected from splashing water by the engine 22*b* and intake system 102*b*. In addition, the injector 112*b* is positioned far from the heat radiated by the exhaust system 120*b*.

A second position for the injector 112*b*' in accordance with this embodiment is also illustrated in FIGS. 6 and 7. In this position, the injector 112*b*' again extends upwardly from the cylinder head 82*b*, but is positioned to that side of the cylinder head 82*b* which is closer to the exhaust system 120*b* than the intake system 102*b*. In this position the injector 112*b*' is again protected from splashing water by the engine 22*b*, and in addition by the exhaust manifold 122*b*.

In accordance with this embodiment of the invention, an additional injector 113*b* may be used to provide additional fuel to each cylinder 84*b* in addition to that supplied by the injectors 112*b* or 112*b*'. In the position illustrated, each injector 113*b* extends generally horizontally through the cylinder block 80*b* to provide fuel to a respective cylinder 84*b*, one injector 113*b* each positioned at the front and rear of the engine 22*b* on either side of the throttle body 108*b* of the intake system 102*b*. In this arrangement, the injectors 113*b* are very isolated from the heat radiated by the exhaust system 120*b* by the body of the engine 22*b*. In addition, the injector 113*b* is still protected from water entering the air ducts 94*b* because their outlet 95*b* is positioned below the injector 113*b*, and to some extent from splashing water by the mounts 57*b* and intake system 102*b*.

Figure 8:
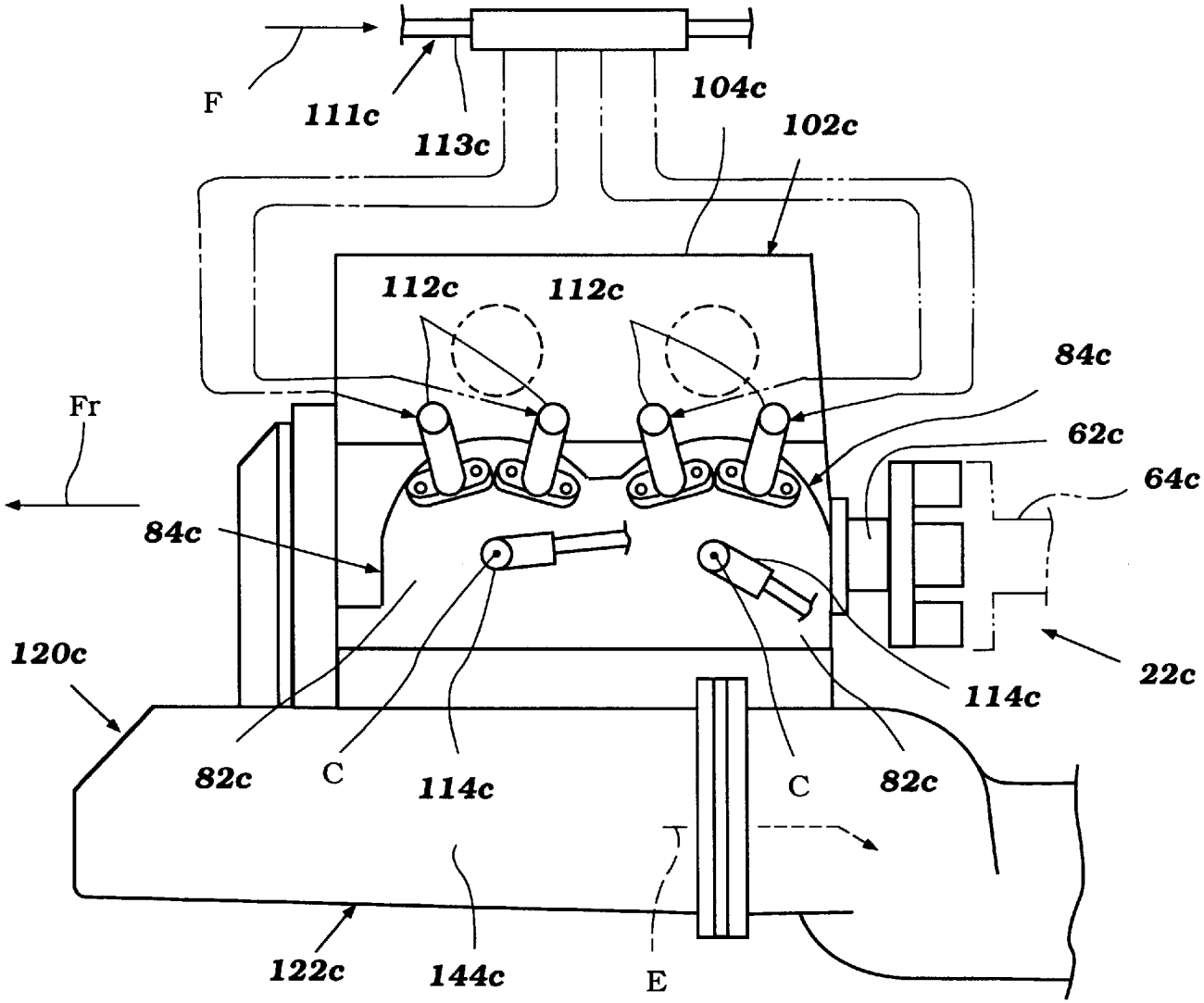
FIG. 8 is a top view of an engine having a fuel injector arrangement in accordance with a fourth embodiment of the present invention.

A fuel injector arrangement in accordance with a fourth embodiment of the present invention is illustrated in FIG. 8. In the description and illustrations of this embodiment of the invention, like or similar parts have been given the same reference numerals as those used in the description and illustration of the previous embodiments, except that a "c" designator has been added to all of the reference numerals used herein.

In this embodiment, the engine 22*c* is arranged similar to that of the embodiment illustrated in FIGS. 6 and 7, with the cylinders 84*c* of the engine 22*c* positioned along an axis C which is vertically extending.

In this arrangement, to eliminate the placement of the additional injector (113*b* in the previous embodiment) for each cylinder 84*c* in the less protected side area of the engine 20*c*, a pair of injectors 112*c* are provided for each cylinder 84*c* extending from the cylinder head 82*c*.

In this arrangement, the pair of injectors 112*c* corresponding to each cylinder 84*c* preferably extend from the cylinder head 82*c* on that side thereof generally opposite the exhaust system 120*c*. In addition, the injectors 112*c* all lean or tilt in the direction away from the exhaust system 120*c*.

As with the previous embodiments, in this embodiment the injectors 112*c* are protected from exposure to splashing water by the engine 22*c* and intake 102*c*. In addition, the injectors 112*c* are protected from the heat generated by the exhaust system 120*c* because they are placed far therefrom and tilt away therefrom. At the same time, this arrangement permits use of two injectors 112*c* per cylinder 84*c*, thus permitting the injection of large quantities of fuel.

Of course, the foregoing description is that of preferred embodiments of the invention, and various changes and modifications may be made without departing from the S spirit and scope of the invention, as defined by the appended claims.

What is claimed is:

1. A watercraft having a hull defining an engine compartment, an internal combustion engine positioned in said engine compartment, said watercraft including a water propulsion device, said engine having an output shaft arranged to power said water propulsion device, at least one air duct providing air through said hull into said engine compartment, said duct leading from said hull to an outlet in said engine compartment, said engine having an intake system for providing air to at least one combustion chamber thereof and a fuel system for providing fuel to said at least one combustion chamber, said fuel system including at least one fuel injector, said injector positioned higher above a bottom of said hull than said outlet of said air duct.

2. The watercraft in accordance with claim 1, wherein said engine comprises a cylinder block having opposing first and second ends, said first end positioned near said bottom of said hull and a cylinder head connected to said second end of said cylinder block, and wherein said injector extends from said cylinder head.

3. The watercraft in accordance with claim 2, wherein said engine includes an exhaust system extending from a first side thereof and said at least one injector extends from a side of said cylinder head generally opposite said first side of said engine.

4. The watercraft in accordance with claim 3, wherein at least two fuel injectors are provided corresponding to each combustion chamber.

5. The watercraft in accordance with claim 3, wherein said at least one injector is angled from said cylinder head in a direction away from said exhaust system.

6. The watercraft in accordance with claim 3, wherein said exhaust system includes a portion which is higher above said bottom of said hull than said injector.

7. A watercraft having a hull defining an engine compartment, an internal combustion engine having a cylinder head connected to a top end of a cylinder block and cooperating with said cylinder block to define at least one combustion chamber, said engine positioned in said engine compartment, said watercraft including a water propulsion device, said engine having an output shaft arranged to power said water propulsion device, at least one air duct providing air through said hull into said engine compartment, said duct leading from said hull to an outlet in said engine compartment, said engine having an intake system for providing air to said at least one combustion chamber thereof, an exhaust system for conveying exhaust gasses from said at least one combustion chamber to the atmosphere and a fuel system for providing fuel to said at least one combustion chamber, said fuel system including at least one fuel injector mounted in said cylinder head and extending upwardly therefrom, at least one of said intake and said exhaust systems having a portion extending along one side of said engine at a level above and to one side of said at least one fuel injector so that said at least one fuel injector is shielded by said engine from water positioned on a lower surface of said hull below said engine.

8. The watercraft in accordance with claim 7, wherein said injector is positioned higher above a bottom of said hull than said outlet of said duct.

9. The watercraft in accordance with claim 7, wherein said engine has at least one cylinder having a centerline offset from vertical.

10. The watercraft in accordance with claim 7, wherein the engine has a plurality of combustion chambers and fuel injectors.

11. The watercraft in accordance with claim 10, wherein system portion is a portion of the intake system.

12. A watercraft having a hull defining an engine compartment, an internal combustion engine having a cylinder head connected to a top end of a cylinder block and cooperating with said cylinder block to define a plurality of combustion chambers, said engine positioned in said engine compartment, said watercraft including a water propulsion device, said engine having an output shaft arranged to power said water propulsion device, at least one air duct providing air through said hull into said engine compartment, said duct leading from said hull to an outlet in said engine compartment, said engine having an intake system for providing air to said combustion chambers thereof, an exhaust system for conveying exhaust gasses from said combustion chambers to the atmosphere and a fuel system for providing fuel to said combustion chambers, said fuel system including a plurality of fuel injectors mounted in said cylinder head, said exhaust system having a portion extending along one side of said engine at a level above and to one side of said fuel injectors so that said fuel injectors are shielded by said engine from water positioned on a lower surface of said hull below said engine.

13. A watercraft having a hull defining an engine compartment, an internal combustion engine having a cylinder head connected to a top end of a cylinder block and cooperating with said cylinder block to define a plurality of combustion chambers, said engine positioned in said engine compartment, said watercraft including a water propulsion device, said engine having an output shaft arranged to power said water propulsion device, at least one air duct providing air through said hull into said engine compartment, said duct leading from said hull to an outlet in said engine compartment, said engine having an intake system for providing air to said combustion chambers thereof, an exhaust system for conveying exhaust gasses from said combustion chambers to the atmosphere and a fuel system for providing fuel to said combustion chambers, said fuel system including a plurality of fuel injectors mounted in said cylinder head, said intake system and said exhaust system each having a portion extending along one side of said engine at a level above and to one side of said fuel injectors so that said fuel injectors are shielded by said engine from water positioned on a lower surface of said hull below said engine.

14. The watercraft in accordance with claim 13, wherein the intake system and the exhaust system portions are on opposite sides of the engine.

* * * * *